US011156026B1

(12) United States Patent
Rowland

(10) Patent No.: US 11,156,026 B1
(45) Date of Patent: Oct. 26, 2021

(54) ELECTRONIC HINGE

(71) Applicant: Component Hardware Group, Inc., Lakewood, NJ (US)

(72) Inventor: James Rowland, Bayville, NJ (US)

(73) Assignee: COMPONENT HARDWARE GROUP, INC., Lakewood, NJ (US)

( * ) Notice: Subject to any disclaimer, the term of this patent is extended or adjusted under 35 U.S.C. 154(b) by 0 days.

(21) Appl. No.: 17/096,023

(22) Filed: Nov. 12, 2020

(51) Int. Cl.

| | |
|---|---|
| ***E05D 5/10*** | (2006.01) |
| ***E05D 11/00*** | (2006.01) |
| ***E05D 3/02*** | (2006.01) |
| ***E05D 5/04*** | (2006.01) |

(52) U.S. Cl.
CPC ..... *E05D 11/0081* (2013.01); *E05D 3/02* (2013.01); *E05D 5/04* (2013.01); *E05Y 2900/132* (2013.01)

(58) Field of Classification Search
CPC ..... Y10T 16/52; Y10T 16/522; Y10T 16/537; Y10T 16/557; Y10T 16/558; H01R 35/02; H01R 35/04; H01H 3/162; H01H 3/161; H01H 13/10; E05D 11/00; E05D 11/0081; E05D 3/02; E05D 2003/025; E05D 2900/531; E05D 2800/678; E05D 7/00; E05D 5/04; G06F 1/1681; G06F 1/1683; B21D 53/10; E05Y 2900/132
See application file for complete search history.

(56) References Cited

U.S. PATENT DOCUMENTS

| | | | | |
|---|---|---|---|---|
| 3,076,163 | A * | 1/1963 | Nodge | H01R 35/02 439/31 |
| 3,355,695 | A * | 11/1967 | Overesch | H01R 35/04 439/31 |
| 4,412,711 | A * | 11/1983 | Suska | E05D 11/0081 16/223 |
| 4,543,800 | A * | 10/1985 | Mawby | E05D 11/0081 439/165 |
| 5,787,724 | A * | 8/1998 | Pohl | B67D 1/0858 16/386 |
| 5,941,619 | A * | 8/1999 | Stieben | F25D 23/028 312/223.6 |
| 7,870,642 | B1 * | 1/2011 | Finkelstein | E05D 7/0423 16/260 |
| 8,517,747 | B2 * | 8/2013 | Bryla | G07C 9/00571 439/165 |
| 8,845,045 | B2 * | 9/2014 | Stubblefield | F25D 23/028 312/405 |
| 9,140,045 | B1 * | 9/2015 | Finkelstein | E05D 7/0045 |
| 9,416,574 | B2 * | 8/2016 | Mitchell | E05D 7/0423 |
| 9,644,411 | B2 * | 5/2017 | Gompper | E05D 7/04 |
| 10,167,657 | B2 * | 1/2019 | Gompper | E06B 5/006 |
| 2013/0305488 | A1 * | 11/2013 | Dodge | G06Q 30/0277 16/245 |

FOREIGN PATENT DOCUMENTS

| | | | | |
|---|---|---|---|---|
| GB | 2497377 | A * | 6/2013 | E05D 7/081 |

* cited by examiner

*Primary Examiner* — Chuck Y Mah
(74) *Attorney, Agent, or Firm* — Francis C. Hand; Carella, Bryce et al

(57) ABSTRACT

The electronic hinge has a female electrical receptacle assembly mounted in a holding bracket and a male receptacle assembly mounted in and extending from a wire connecting cam of a hollow cam sub-assembly mounted in a hub of a flange assembly.

4 Claims, 5 Drawing Sheets

ELECTRONIC HINGE

This invention relates to an electronic hinge. More particularly, this invention relates to an electronic hinge of the walk-in type for a door having an electrical appliance therein or thereon.

As is known, various doors have been constructed to be mounted in hinged fashion to a cabinet or within a door frame. In particular, doors have been constructed to be hinged onto the front of a cabinet, such as a refrigerated cabinet used in many supermarkets, and the like. Typically, such a door is constructed of an insulated glass unit (IG unit) of rectangular shape with at least a pair of glass panes (or lites) and a perimeter spacer system that functions as a means for maintaining the glass panes in parallel spaced apart relation. In addition, in some cases, the glass unit has been electrically heated to prevent surface condensation on the glass panes while, in other cases, a light fixture has been incorporated in the glass unit to illuminate the interior of the cabinet on which the door is mounted.

In situations where electrically heated glass is required, the IG unit can be provided with a transparent electrically conductive heating film bonded to at least one of the panes and a pair of electrically conductive bus bars mounted in electrical contact on the coated pane or panes of glass on opposite sides of the coated pane or panes of glass.

Various types of electrical connectors have also been employed to deliver electrical power to the doors with IG units, such as described in U.S. Pat. No. 3,760,157.

U.S. Pat. No. 10,167,657 describes a hinge assembly for an insulated door that provides for the delivery of electrical power through the hinge assembly to electrical appliances within a door.

Accordingly, It is an object of the invention to provide a hinge for a door on a cabinet or the like that allows for the delivery of electrical power through the hinge into an electrical appliance inside the cabinet in a simple manner.

It is another object of the invention to deliver power through a hinge of a door to an appliance within the door.

Briefly, the invention provides an electronic hinge, for example, of the cam rise walk-in door hinge type that is constructed to allow for the delivery of electrical power through the hinge.

The hinge is comprised of a holding bracket for mounting on a support, a flange assembly pivotally mounted on the holding bracket for mounting on a door, a female electrical receptacle assembly in the holding bracket and a male receptacle assembly mounted in the flange assembly and in electrical communication with said female electrical receptacle assembly.

In addition, the hinge is provided with a cam arrangement to effect a lifting of the door relative to the support during movement of the door between a closed position and an open position.

The holding bracket is constructed with a support plate with an opening in the base and an upstanding housing defining a longitudinally extending cavity therein The female electrical receptacle assembly is mounted within the cavity of the housing and in communication with the opening to receive power via a suitable electrical cable. A female lift style cam is also mounted within the cavity of the housing in spaced relation to the receptacle assembly.

The flange assembly includes a hollow cam sub-assembly disposed in mating relation with the female lift style cam and has a wire connecting cam at one end in facing relation to the female electrical receptacle assembly in the holding bracket. In addition, the male receptacle assembly is mounted in and extends from the wire connecting cam into electrical communication with the female electrical receptacle assembly.

These and other objects of the invention will become more apparent from the following description taken in conjunction with the accompanying drawings wherein.

Figure 2:
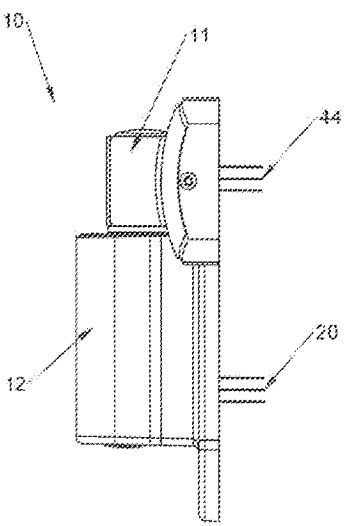
FIG. 2 illustrates a side view of the hinge of FIG. 1.
Figure 1:
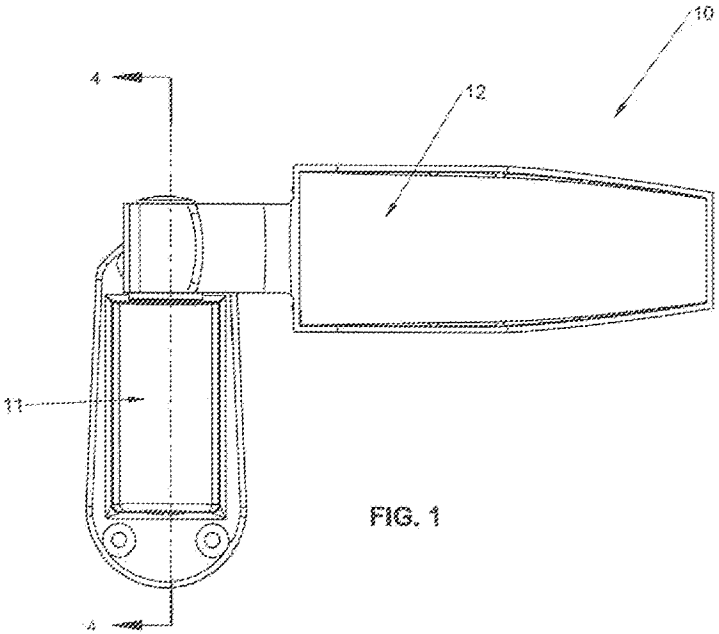
FIG. 1 illustrates a plan view of a hinge constructed in accordance with the invention.
Figure 3:
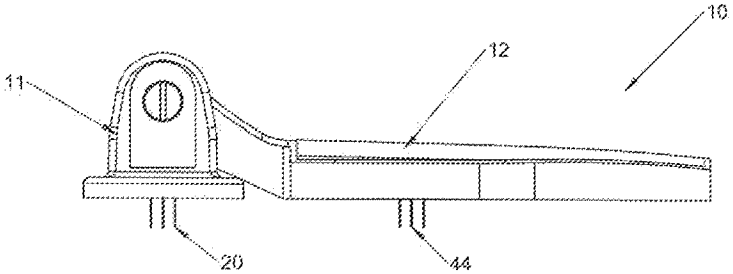
FIG. 3 illustrates a front side view of the hinge of FIG. 1.

Referring to FIGS. 1, 2 and 3, the electronic hinge 10 is comprised of a holding bracket 11 for mounting on a support (not shown) and a flange assembly 12 pivotally mounted on the holding bracket 11 for mounting on a door (not shown).

Figure 5:
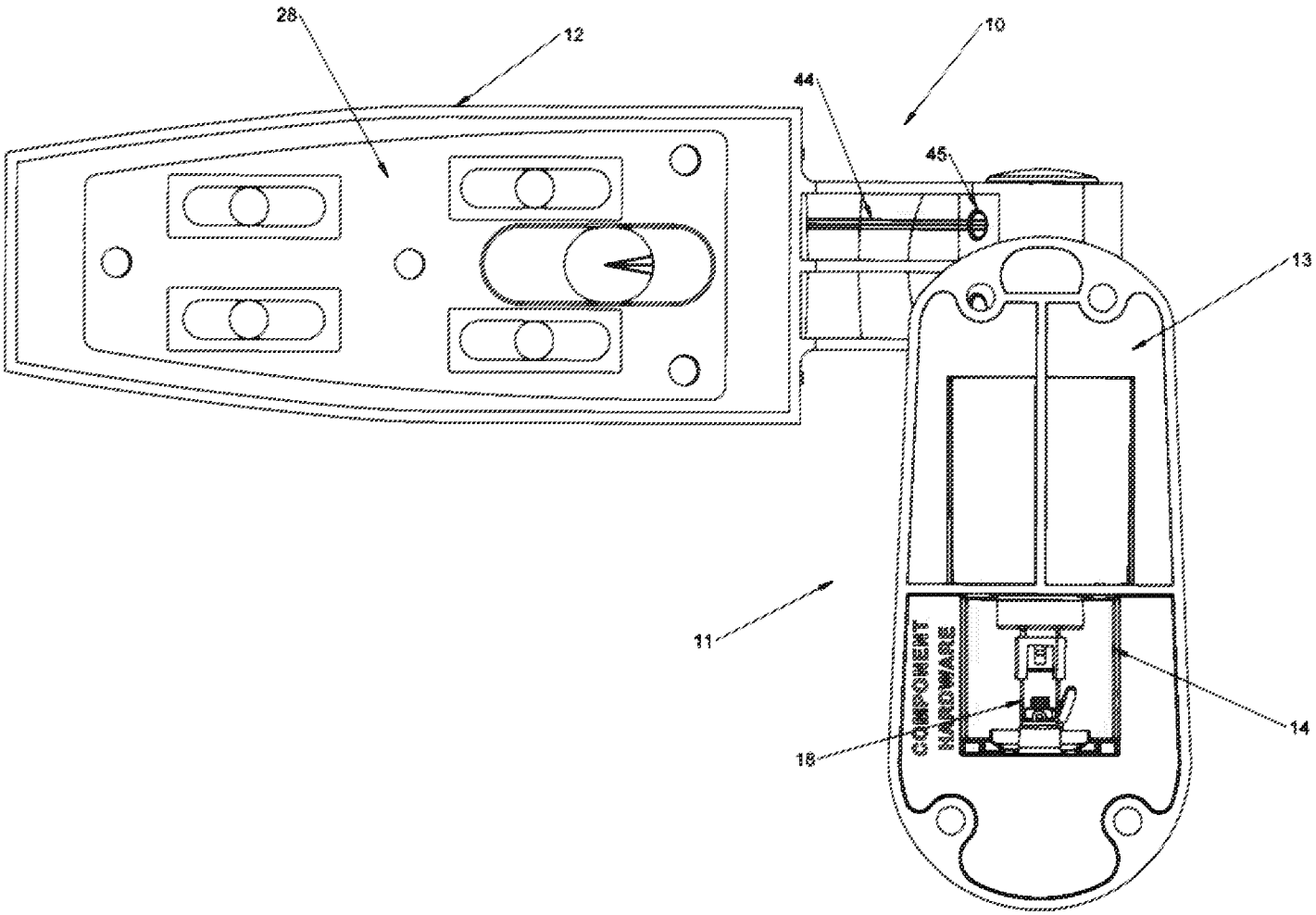
FIG. 5 illustrates a bottom view of the hinge of FIG. 1.
Figure 6:
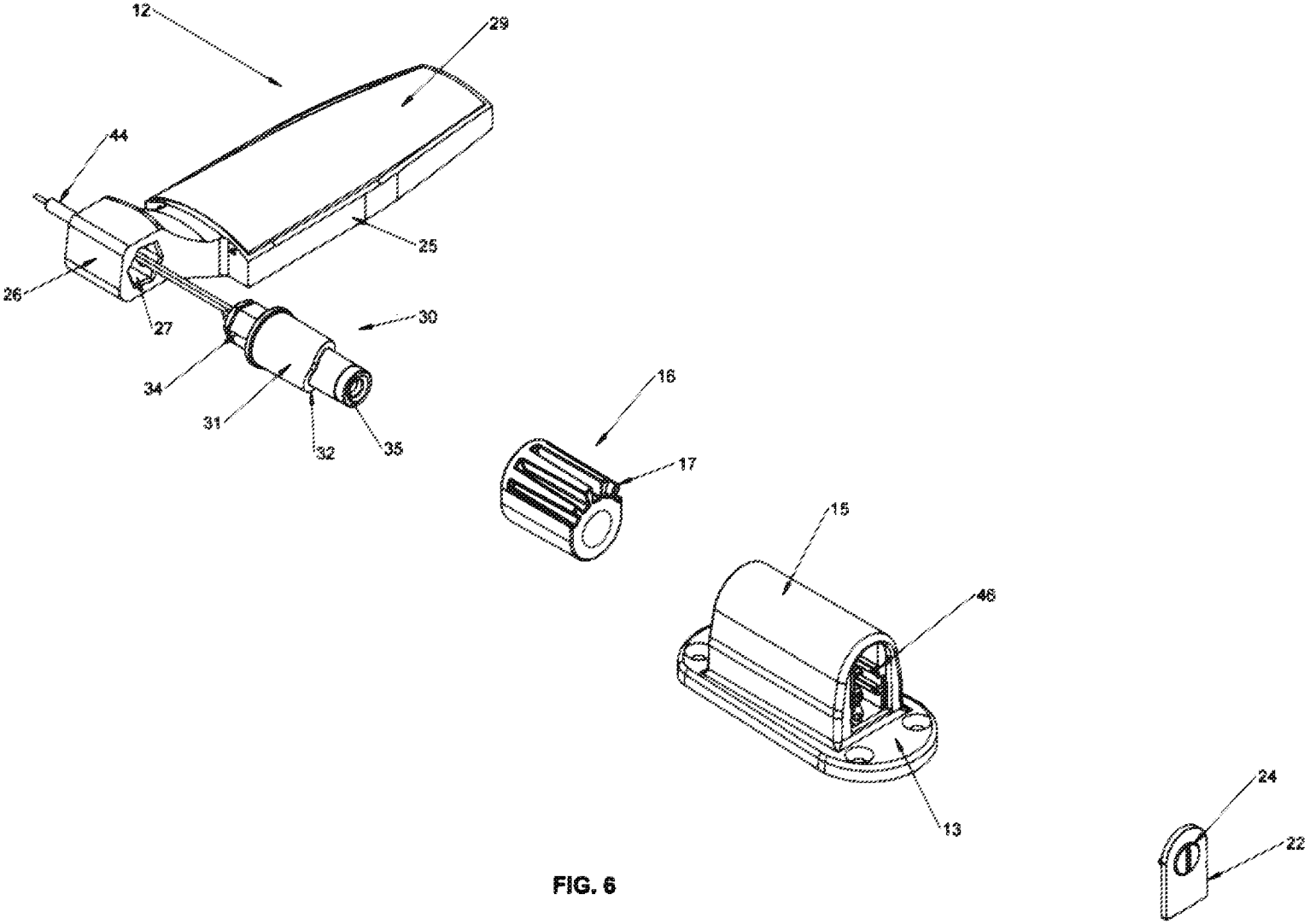
FIG. 6 illustrates an exploded view of some of the parts of the hinge of FIG. 1.

Referring to FIG. 6, the holding bracket 11 is made of metal and has a support plate 13 with an opening 14 (FIG. 5) in the base and an upstanding housing 15 defining a longitudinally extending cavity therein.

Figure 4:
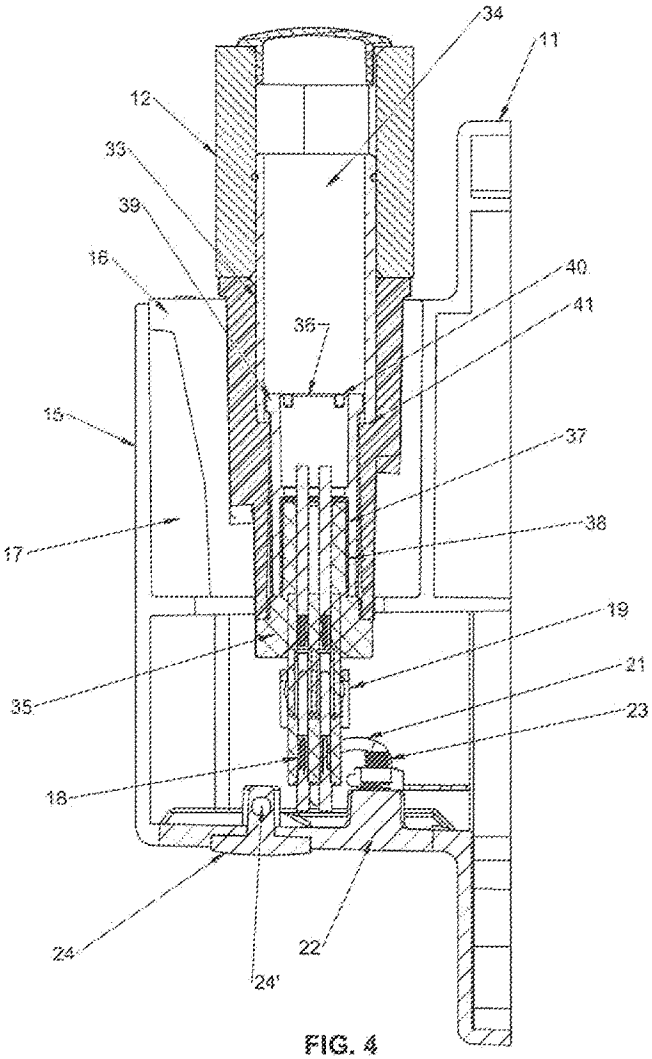
FIG. 4 illustrates a cross-sectional view taken on line 4-4 of FIG. 1

Referring to FIGS. 4 and 6, a female lift style cam 16 of conventional structure is mounted within the cavity of the housing 15 to effect a simultaneous vertical movement of the flange assembly 12 during pivoting of the flange assembly 12 on the holding bracket 11. The cam 16 includes a plurality of spaced apart ribs 17 for reducing the mass of the cam 16.

The cam 16 also has an internal cam surface (not shown) for purposes described below.

Referring to FIGS. 4 and 5, a female electrical receptacle assembly 18 is also mounted within the cavity of the housing 15 in spaced relation to the cam 16 and in communication with the opening 14 to receive an electrical cable (not shown).

As indicated in FIG. 4, the female electrical receptacle assembly 18 includes a receptacle housing 19 that receives a plurality of electrical wires 20 that pass through the opening 14 in the support plate 13 for a flow of electrical power and a non-insulated ring connector 21 that is connected to one of the wires 20.

A plate assembly 22 is removably mounted on the holding bracket 11 to close off the cavity of the housing 15 and has a threaded stud 23 that receives the ring connector 21 in electrical conductive manner.

As illustrated in FIGS. 4 and 6, the plate assembly 22 is provided with a locking mechanism 24 that secures the plate assembly 22 in the holding bracket 11. This locking mechanism 24 includes a T-shaped cap with a slotted head that is rotatably received in a recess of the plate assembly 22 and a stem that projects through the plate assembly 22 and has a transverse through bore for receiving a pin 24' in press-fit manner. (see FIG. 4).

A flat surfaced object, such as a screw driver, is used to rotate the T-shaped cap so that the pin can be rotated 90° between a locking position locking the plate assembly 22 in the holding bracket 11 and an unlocked position allowing the entire plate assembly 22 to be removed from the holding bracket 11. When in the locking position, the pin 24' projects behind a pair of flanges 46 (see FIG. 6) disposed on opposite sides of the opening in the end of the holding bracket 11.

Figure 7:
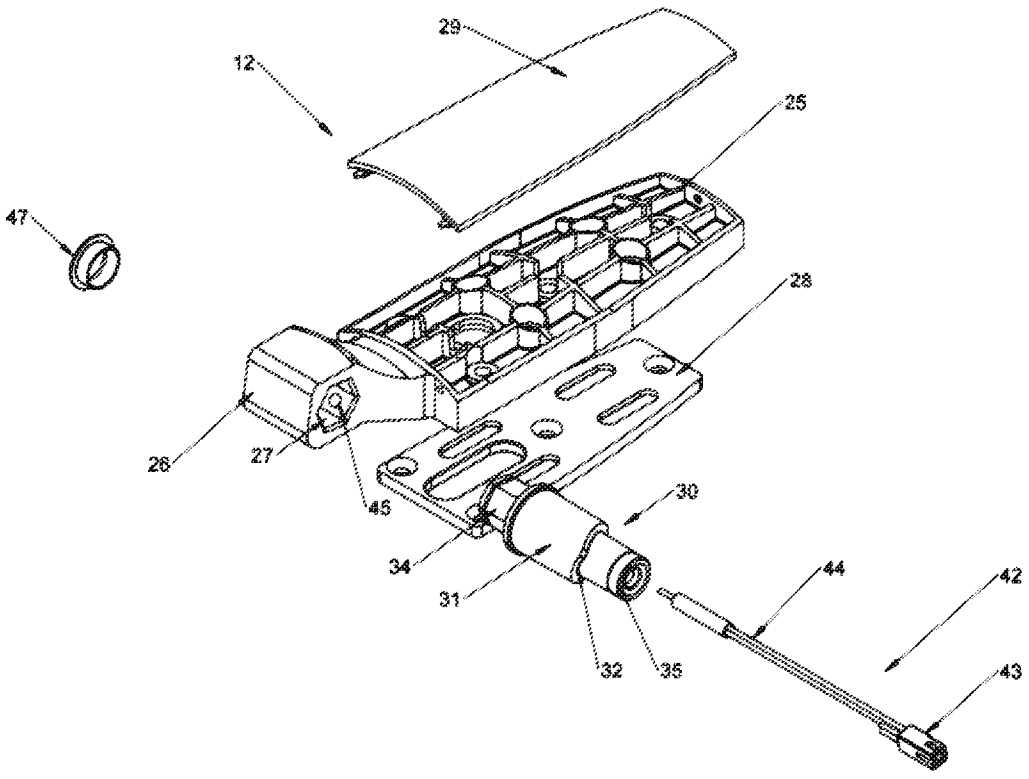
FIG. 7 illustrates an exploded view of the flange assembly of the hinge of FIG. 1.
Figure 8:
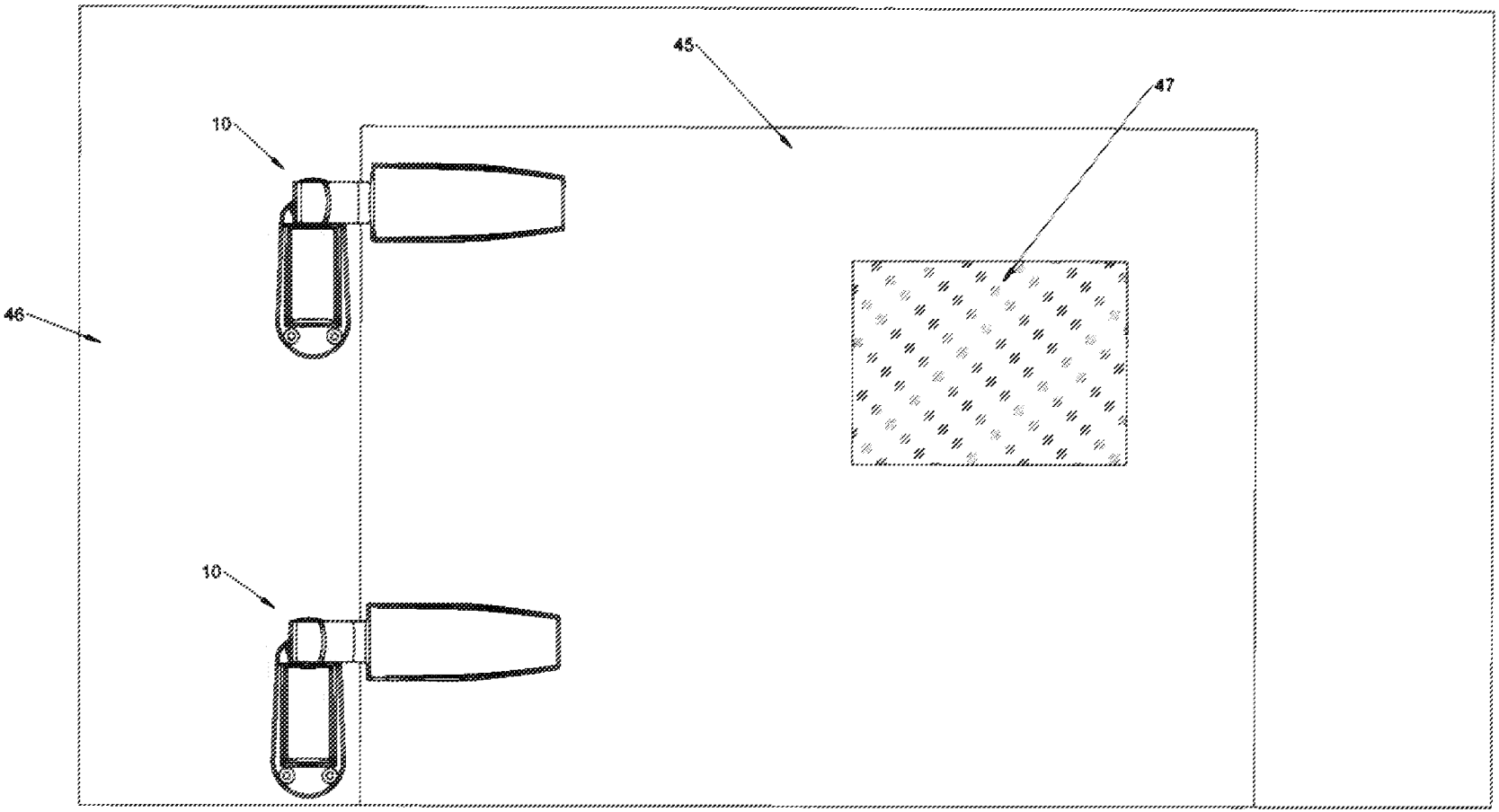
FIG. 8 illustrates a partial front view of a door mounted on a cabinet by a pair of hinges each of which is constructed as in FIG. 1.

Referring to FIGS. 4, 6 and 7, the flange assembly 12 includes a flange door bracket 25 having a hub 26 at one end with a polygonal bore 27 extending therethrough, a wire pass through adjusting plate 28 on an underside of the bracket 25 and a cover 29 on the topside of the bracket 25.

The flange assembly 12 receives a hollow cam sub-assembly 30 that cooperates with the female lift style cam 16 in the holding bracket 11 to effect a simultaneous vertical movement of the flange assembly 12 during pivoting of the flange assembly 12 on the holding bracket 11.

The cam sub-assembly 30 includes a hollow male lift style cam 31 with an external cam surface 32 that is disposed in mating relation with the internal cam surface (not shown) of the female lift style cam 16 as well as a bore 33 of polygonal shape.

The cam sub-assembly 30 also includes a hollow pin 34 of polygonal shape that is matingly received in the bore 33 of the cam 31 and in the bore 27 of the hub 26 to rotate the cam sub-assembly 30 as the flange assembly 12 pivots on the holding bracket 11.

Referring to FIG. 4, the cam sub-assembly 30 also includes a wire connecting cam 35 at one end of the male lift style cam 31 and a cylindrical cam holder 36 inserted into the hollow pin 34 from an opposite end of the male lift style cam 31. The cam 35 has an externally threaded stem 37 and the cam holder 36 has an internally threaded end section 38 that is threaded into engagement with the cam 35 to hold the cam 35 within the cam sub-assembly 30.

The cam holder 36 has an enlarged circular collar 39 at one end that has a plurality of slots 40 to provide resiliency for press-fitting the cam holder 36 into the hollow pin 34. The collar 39 is also sized to abut a circumferential shoulder 41 within the male lift style viewed, of the male lift style cam 31.

Referring to FIG. 7, a male receptacle assembly 42 is mounted in and extends from the wire connecting cam 35 of the cam sub-assembly 30.

The male receptacle assembly 42 includes an electrical receptacle housing 43 at one end and a plurality of wires 44 that extend from the housing 43 through the cam sub-assembly 30 and through the hub 26. The wires 44 also pass through a bore 45 in the hub 26 (see FIG. 5) and extend through the flange door bracket 25 and adjusting plate 28 into the door (not shown) that the hinge 10 is mounted on.

Referring to FIG. 4, the male receptacle assembly 42 is in electrical communication with the female electrical receptacle assembly 18 by sliding the housing 43 of the ale receptacle assembly 42 into the receptacle housing 19 of the female electrical receptacle assembly 18.

Referring to FIG. 7, during assembly, the wires 44 are threaded through the bore 45 in the hub 26 for passage through the flange door bracket 25 and adjusting plate 28. Thereafter, a cap 47 is inserted into the bore 27 of the hub 26 to close off the bore 27.

The invention thus provides an electronic hinge for a door of the walk-in type that allows for the delivery of electrical power through the hinge, for example, to an appliance within the door.

What is claimed is:

1. A hinge comprising a holding bracket for mounting on a support, said bracket having a support plate with an opening therein and an upstanding housing defining a longitudinally extending cavity therein;

a female electrical receptacle assembly mounted within said cavity of said housing and in communication with said opening to receive an electrical cable;

a female lift style cam mounted within said cavity of said housing in spaced relation to said receptacle assembly;

a flange assembly pivotally mounted on said holding bracket for mounting on a door, said flange assembly including a hollow cam subassembly disposed in mating relation with said female lift style cam and having a wire connecting cam at one end thereof in facing relation to said female electrical receptacle assembly in said holding bracket; and a male receptacle assembly mounted in and extending from said wire connecting cam into electrical communication with said female electrical receptacle assembly.

2. A hinge as set forth on claim 1 wherein said flange assembly includes a flange door bracket having a hub at one end with a polygonal bore extending therethrough and said hollow cam subassembly includes a pin of polygonal shape matingly received in said bore of said hub to pivot therewith and a male style lift cam having a bore of polygonal shape receiving said pin to pivot therewith.

3. A hinge as set forth in claim 2 wherein said wire connecting cam has a cylindrical stem disposed in said male lift style cam and wherein said flange assembly further includes a cylindrical cam holder disposed in said male lift style cam in opposition to and in press-fit relation with said stem of said wire connecting cam, said cylindrical cam holder having a collar in press-fit relation with a cylindrical interior of said pin.

4. A hinge as set forth in claim 2 wherein said a male receptacle assembly includes at least one wire extending through said hollow cam sub-assembly, said hub, and said flange door bracket.

* * * * *